US011796172B2

(12) United States Patent
Pape et al.

(10) Patent No.: US 11,796,172 B2
(45) Date of Patent: Oct. 24, 2023

(54) PORTABLE FLARING APPARATUS

(71) Applicant: All American Services, LLC, Greeley, CO (US)

(72) Inventors: Jacob Micah Pape, Commerce City, CO (US); Justin Curtis Carlson, Johnstown, CO (US)

(73) Assignee: All American Services, LLC, Greeley, CO (US)

( * ) Notice: Subject to any disclaimer, the term of this patent is extended or adjusted under 35 U.S.C. 154(b) by 233 days.

(21) Appl. No.: 16/883,329

(22) Filed: May 26, 2020

(65) Prior Publication Data

US 2021/0239315 A1 Aug. 5, 2021

Related U.S. Application Data

(60) Provisional application No. 62/968,031, filed on Jan. 30, 2020.

(51) Int. Cl.

| | |
|---|---|
| ***F23G 5/40*** | (2006.01) |
| ***E21B 41/00*** | (2006.01) |
| ***F23G 7/08*** | (2006.01) |
| ***F23N 5/24*** | (2006.01) |

(52) U.S. Cl.

CPC ..... *F23G 5/40* (2013.01); *E21B 41/0071* (2013.01); *F23G 7/085* (2013.01); *F23N 5/247* (2013.01); *F23G 2203/601* (2013.01); *F23G 2209/141* (2013.01); *F23N 2241/18* (2020.01)

(58) Field of Classification Search

CPC ... F23G 7/085; F23G 5/40; F23G 7/08; F23G 2203/601; F23G 2209/14; F23G 5/24; F23G 7/06; F23G 2900/54402; F23G 2203/70; F23G 2209/141; E21B 41/0071; F23J 13/025; F23D 2900/00018; F23D 2900/11002; F23D 2900/11403; F23D 2209/10; F23D 2209/00; F23D 14/82; F23D 14/825; E04H 12/182; E04H 12/00; E04H 12/18; E04H 12/185; E04H 12/28; F23N 5/247; F23N 2241/18

USPC ..... 431/346, 5, 202, 279, 351, 353; 110/240

See application file for complete search history.

(56) References Cited

U.S. PATENT DOCUMENTS

| | | | | |
|---|---|---|---|---|
| 3,807,940 A * | 4/1974 | Juricek | B01F 25/311 | 431/351 |
| 3,938,450 A * | 2/1976 | Jaronko | F23G 5/20 | 110/260 |
| 3,939,783 A * | 2/1976 | du Chambon | F23G 5/40 | 432/105 |
| 4,468,193 A * | 8/1984 | Lawrence | F23G 7/08 | 431/89 |
| 5,415,233 A * | 5/1995 | Roussakis | B01J 19/002 | 169/48 |
| 5,490,364 A * | 2/1996 | Desai | E21B 41/0071 | 52/121 |

(Continued)

*Primary Examiner* — Alfred Basichas

(74) *Attorney, Agent, or Firm* — Sheridan Ross PC

(57) ABSTRACT

A portable flaring apparatus is disclosed. The flaring apparatus comprises a stack comprising multiple segments of varying diameters, which may be configured to be telescoped for transport. The flaring apparatus further comprises one or more inlets for the intake of gas, an arrester for suppressing flames and detonation within the flaring system, and a plurality of combustion tips for flaring gas. The components of the flaring apparatus may be affixed to a trailer platform for portability.

16 Claims, 8 Drawing Sheets

(56) References Cited

U.S. PATENT DOCUMENTS

| | | | | |
|---|---|---|---|---|
| 5,649,820 | A * | 7/1997 | Keller | F23G 7/085 431/352 |
| 6,012,917 | A * | 1/2000 | Wiseman | F23G 7/08 431/351 |
| 7,677,883 | B2 * | 3/2010 | Harless | F23G 7/08 431/278 |
| 7,966,777 | B2 * | 6/2011 | Douglas | E04H 12/182 52/118 |
| 8,549,812 | B1 * | 10/2013 | Peng | H01Q 1/10 52/843 |
| 8,935,901 | B2 * | 1/2015 | Petrello | E21B 15/00 52/745.03 |
| 9,739,481 | B2 * | 8/2017 | Lang | F23C 9/00 |
| 2003/0059732 | A1 * | 3/2003 | Coffey | F23G 7/08 431/352 |
| 2008/0081304 | A1 * | 4/2008 | Poe | F23G 7/08 431/202 |
| 2009/0071136 | A1 * | 3/2009 | Smith | F01N 13/082 60/324 |
| 2010/0218958 | A1 * | 9/2010 | Cooling | A62C 4/02 169/45 |

* cited by examiner

PORTABLE FLARING APPARATUS

RELATED APPLICATION DATA

This application claims the benefit of and priority under 35 U.S.C. § 119(e) to U.S. Patent Application No. 62/968,031, filed Jan. 30, 2020, entitled "PORTABLE FLARE TOWER," which is incorporated herein by reference in its entirety.

FIELD OF THE INVENTION

The present disclosure is generally directed to devices, systems and methods for emissions control. In particular, the present disclosure provides devices, systems and methods for flaring excess natural gas from an abandoned oil or gas well.

BACKGROUND OF THE INVENTION

An oil or gas well is plugged and abandoned when it is no longer of use. Several steps must be performed in the abandonment process in order to ensure that the abandoned well does not pose a risk to public health or safety. These steps are generally governed by federal, state, and local regulations, as well as industry standards and practices.

One such step involves burning off excess gas prior to plugging the abandoned well, a process known as "flaring." Flaring traditionally involves piping gas into an array of combustible flare tips that use electricity to ignite the gas. The flare tips are disposed within a stack, similar to a smoke stack, which directs the emissions and other byproducts of the flaring process upward toward the atmosphere. However, several other components are necessary in the flaring apparatus in order to ensure the safe and proper flow of gas toward the burners as well as the safe and proper venting of emissions.

It is inefficient for well operators to construct flaring equipment at a well that is to be abandoned. Accordingly, there is a need for a portable flaring apparatus including a portable stack that can be transported to the sites of abandoned wells in order to flare the excess gas. A key challenge in portable flaring apparatuses involves the stack, which must be of a sufficient height for proper venting of emissions. The required size of the tower poses challenges for portability of the apparatus, as large stacks are difficult to transport safely.

Additionally, there is a need to maximize the number of flare tips in order to flare excess gas as quickly and efficiently as possible. The number of flare tips is limited by the size of the stack, the maximum density of the flare tip array that can be achieved without inappropriately compromising safety, and the maximum burn and flow rate available in the apparatus without inappropriately compromising safety. Accordingly, a need exists for robust flaring apparatuses that can support high flaring rates and high gas flows.

SUMMARY OF THE INVENTION

It is an object of the present disclosure to provide a portable flaring apparatus that includes a flare toward that can be transported safely and efficiently while providing enough protection for high rates of flaring.

It is a further object of the present disclosure to provide a portable flaring apparatus with components that allow for high rates of flaring without creating undue health or safety risk.

Aspects of the present disclosure include a portable apparatus that may be mounted on a trailer platform. The apparatus comprises a flame suppressor, which may be a detonation flame arrester, of sufficient strength to allow for the safe flaring of gas at a high rate.

Aspects of the present disclosure include a portable stack. The stack may comprise multiple segments of varying diameters that can be telescoped in order to reduce the height of the stack during transport. Aspects of the present disclosure further include a portable stack comprising an interior shaft and an exterior shaft, thereby fortifying the strength of the stack.

BRIEF DESCRIPTION OF THE DRAWINGS

The exemplary embodiments of the invention will be described in detail, with reference to the following figures wherein.

DETAILED DESCRIPTION

A portable flaring apparatus is described herein. An exemplary application for the portable flaring apparatus is burn off of natural gas from oil and gas extraction wells.

Figure 1:
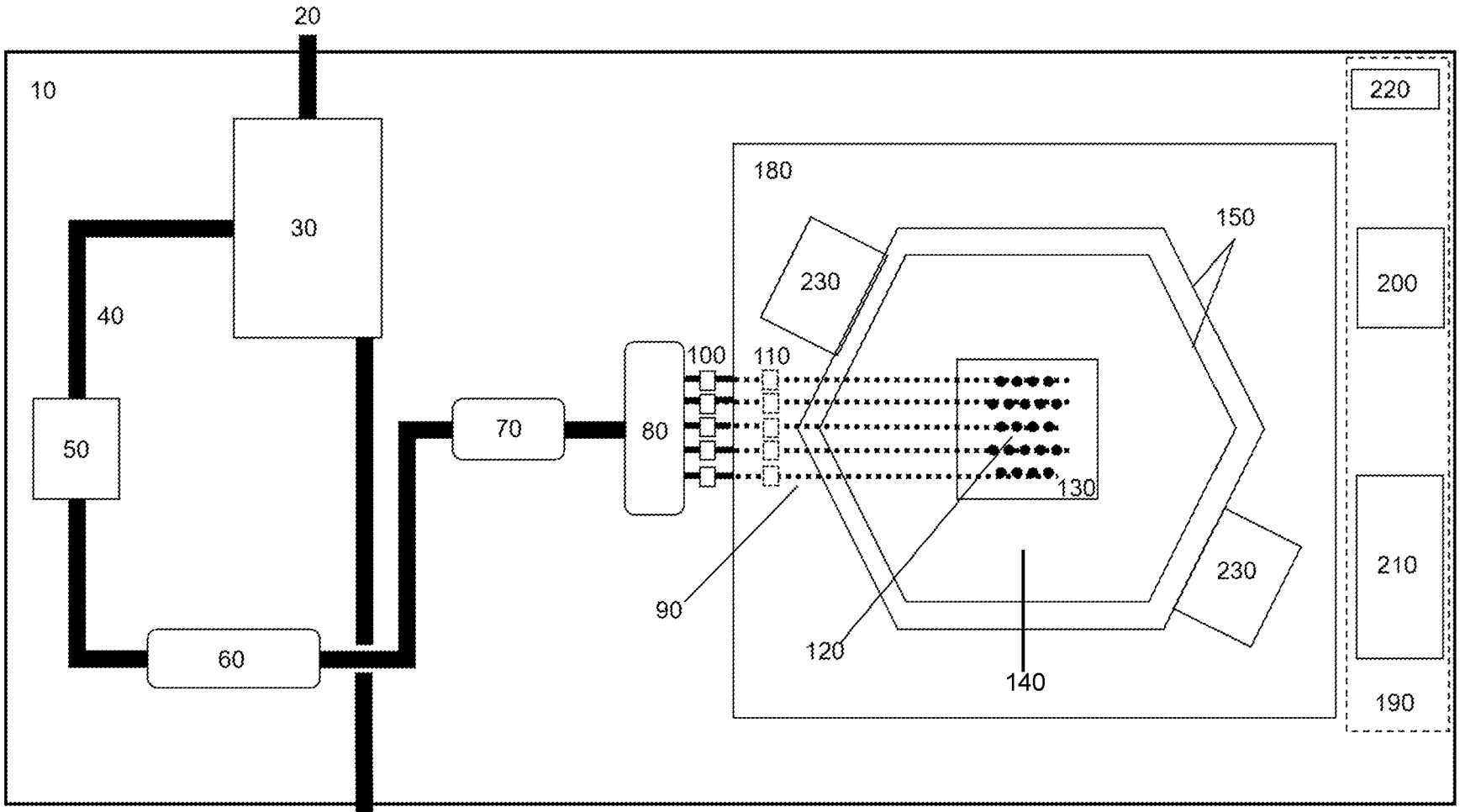
FIG. 1 depicts a portable flaring apparatus in accordance with one embodiment of the present disclosure.

An embodiment of the present disclosure will be described in reference to FIG. 1.

The apparatus is disposed upon a movable platform 10 such as a trailer. Preferably certain components are securely attached to the platform.

The apparatus comprises one or more inlets 20 (in a preferred embodiment, there are two inlets) connected to a volume pot 30 or other component in which liquid may be separated from natural gas. The volume pot is connected to a meter pipe 40 associated with a meter 50. The meter pipe is connected to a master control valve 60 which can be used to shut off the flow of gas. The master control valve is connected to a device 70 configured to substantially prevent the transmission of flames, such as a flame arrester, detonation arrester, detonation flame arrester, or blast arrester. Such a component is configured to allow the flow of gas but substantially prevent the energy from combustion from traveling back through the connecting pipe toward the volume pot. Such a device may operate, for example, by lowering the temperature of the gas to prevent combustion, venting energy, absorbing energy, or a combination of such operations. The device will be referred to as a "blast arrester."

The blast arrester is connected to a manifold 80 comprising a plurality of connections 90 with associated valves 100 and joiners 110, allowing the connections to be independently opened, closed, and/or detached (in a preferred embodiment, there are five connections). The connections are connected to a plurality of combustion tips 120 configured to combust natural gas. In a preferred embodiment, the combustion tips are electrically ignitable. The combustion tips are disposed within a burner box 130.

A stack 140 is disposed surrounding the combustion tips. In a preferred embodiment, the stack is polygonal in shape. In one embodiment, the stack is hexagonal in shape.

Figure 2:
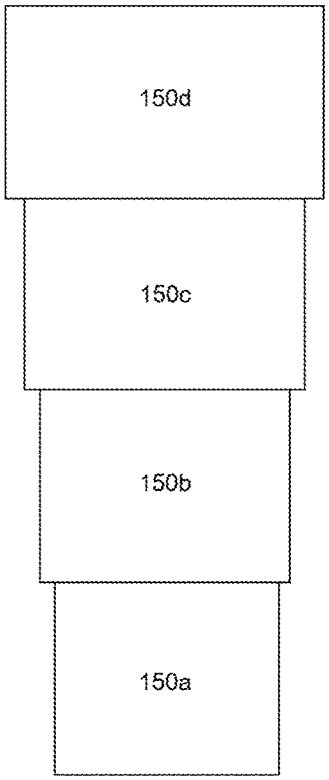
FIG. 2 depicts a stack in accordance with one embodiment of the present disclosure.
Figure 2:
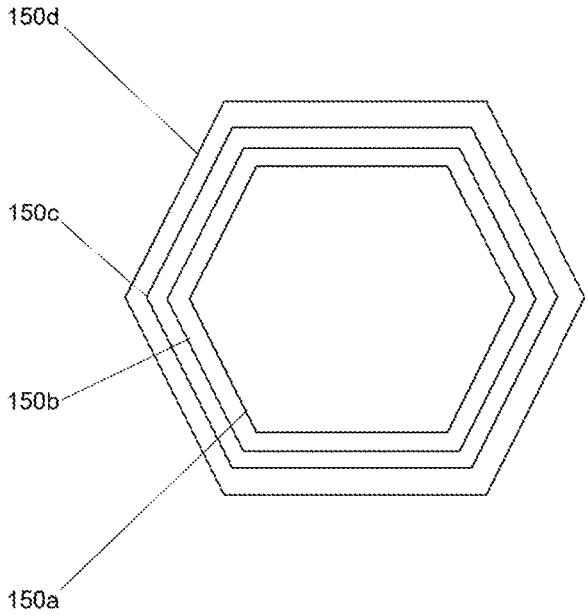
Figure 3:
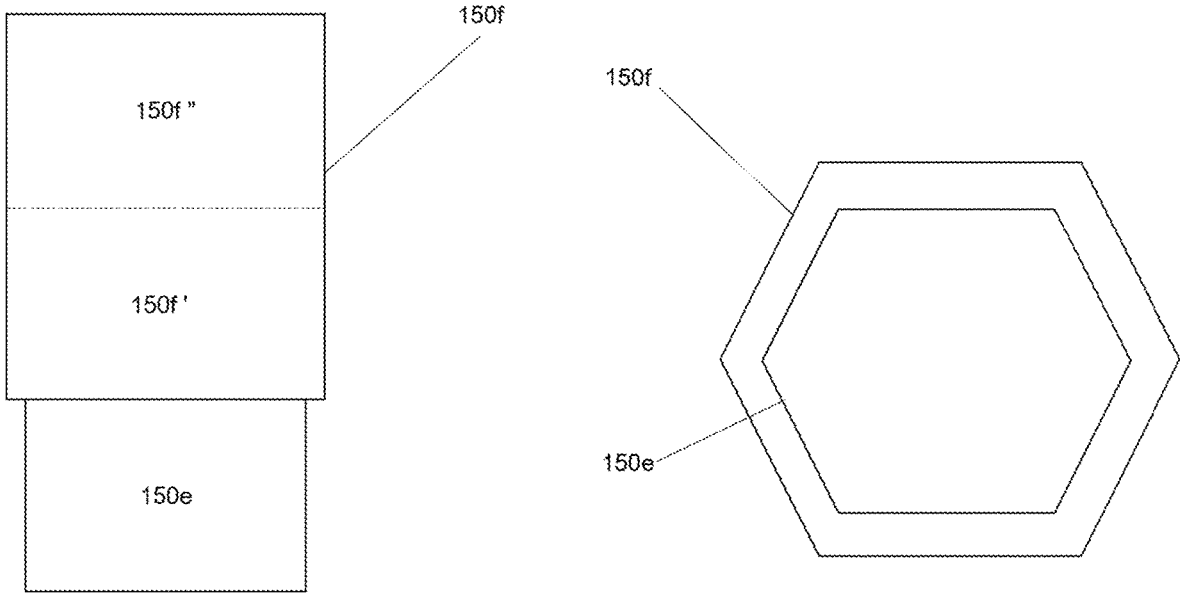
FIG. 3 depicts a stack in accordance with one embodiment of the present disclosure.

The stack may take various forms. In one embodiment, the stack comprises a plurality of movable telescoping segments 150 of varying sizes such that the segments can be nested within each other for transport. In one embodiment, shown in FIG. 2, the stack comprises four such segments 150*a*, 150*b*, 150*c*, and 150*d*, of substantially the same height but varying widths. In a separate embodiment, shown in FIG. 3, the stack comprises two such segments 150*e* and 150*f*, wherein the top segment 150*f* is larger in width than the bottom segment 150*e* and approximately twice the height of the bottom segment. In a further embodiment the top segment 150*f* is formed from two subsegments 150*f* and 150*f'*, which are larger in width than the bottom segment but substantially equal in height to the bottom segment, welded together. The segments may take various shapes and sizes. The stack may be non-telescoping. The stack may comprise a single segment. The stack may comprise a single segment formed of welded subsegments. The stack may comprise one or more segments formed of welded subsegments.

Figure 4:
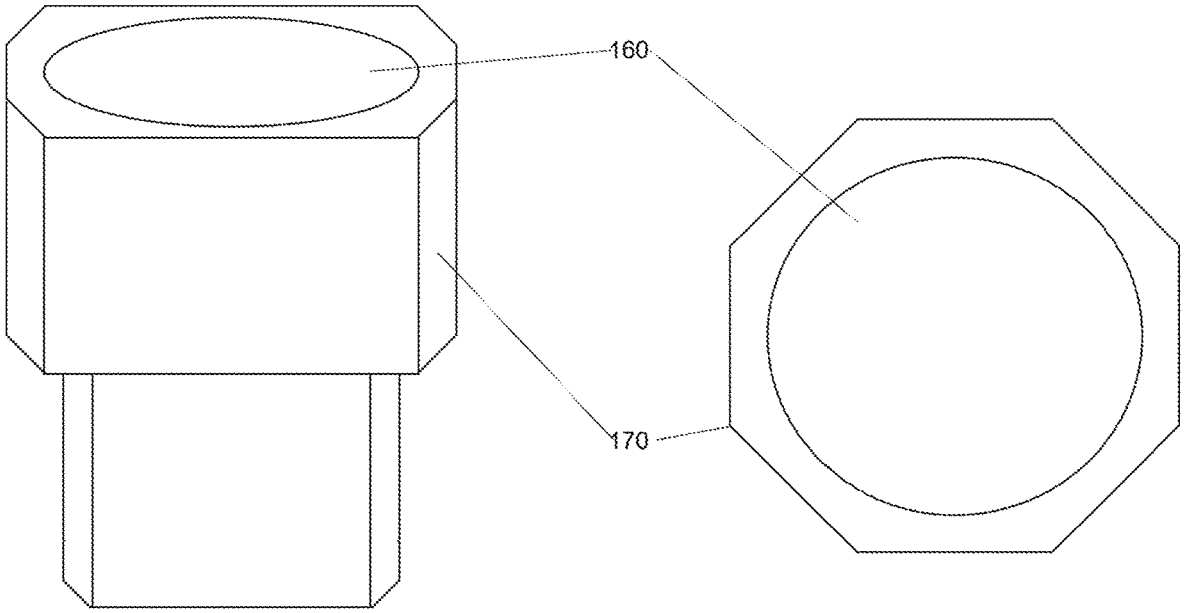
FIG. 4 depicts a stack in accordance with one embodiment of the present disclosure.
Figure 4A:
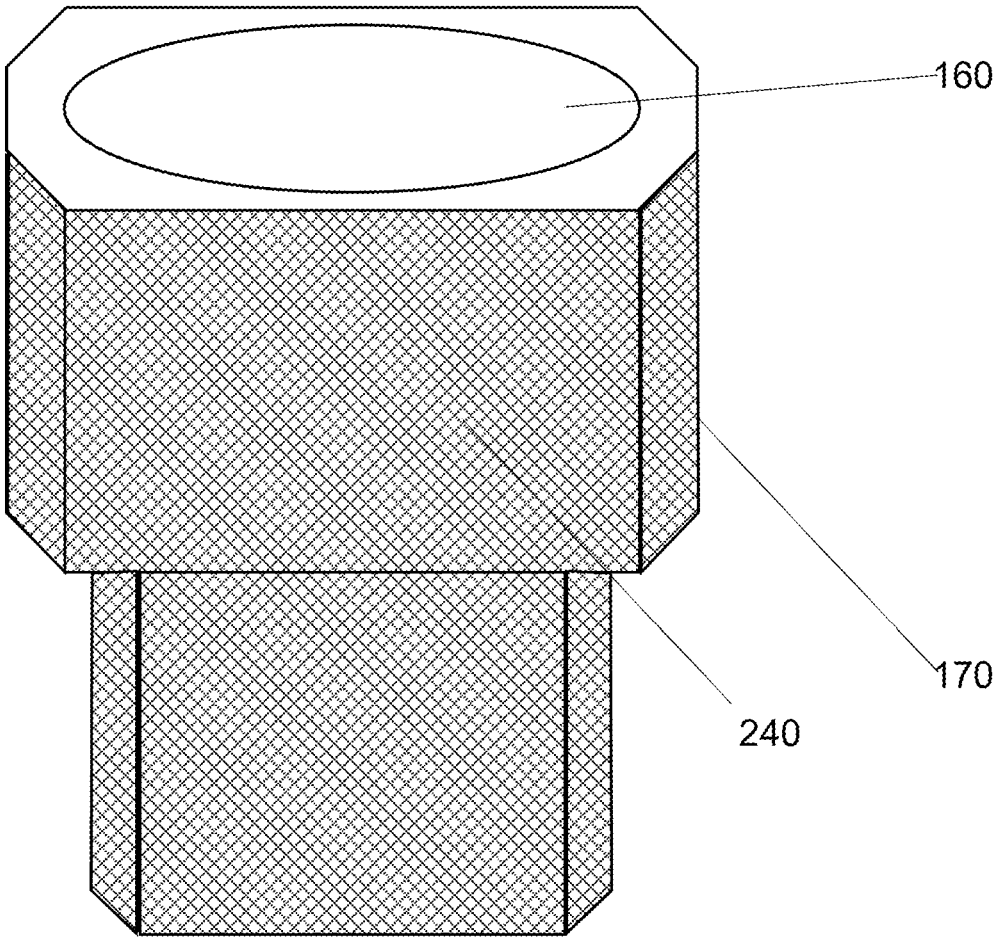
FIG. 4A depicts a stack in accordance with one embodiment of the present disclosure.

The stack may comprise a cylindrical interior shaft 160 surrounded by a polygonal exterior shaft 170, such as an octagonal shaft, as shown in FIG. 4. The polygonal exterior shaft may be comprised of expanded metal grating 240 as shown in FIG. 4A, and may comprise a plurality of telescoping or non-telescoping segments.

In a preferred embodiment, a second platform 180 is disposed on the movable platform 10 on which the stack 140 is disposed. In this embodiment, the top of the burner box 130 is substantially coplanar with the top surface of the second platform 180. The bottom of the burner box may be substantially coplanar with the top surface of the movable platform 10.

A hydraulic assembly 190 may be disposed on the platform to control the telescoping stack, i.e. to move the movable segments up and down. In a preferred embodiment the hydraulic assembly comprises a hydraulic pump 200, a hydraulic tank 210, and hydraulic controls 220.

A plurality of adjustable air intake mechanisms 230 may be configured on the exterior of the stack to control the flow of air through the stack to ensure even burning by the combustion tips.

The various connections may be metal pipes or other suitable connections.

The number of combustion tips may be determined based on the size of at least the bottom stack segment. It will be understood that a maximum number of combustion tips can be determined based on the area inside the stack and the minimum spacing required between combustion tips for safe operation.

Operation of the portable flaring apparatus will now be described with reference to a preferred embodiment.

The movable platform is transported to a site requiring natural gas combustion, such as an oil well that is to be capped and abandoned. In this embodiment, the telescoping stack consists of a first hexagonal segment and a second hexagonal segment having a diameter larger than the first hexagonal segment and a height twice the height of the first hexagonal segment. The second hexagonal segment is formed of two hexagonal subsegments having the same height as the first hexagonal segment welded together. In transport mode, the second hexagonal segment is in a lowered position such that the height of the stack is minimized to facilitate safe transport. For example, the bottom of the second segment may be substantially coplanar with the surface of the second platform when in transport mode. At the site, the apparatus is placed in job mode and the hydraulic assembly is used to cause the second hexagonal segment to move upward until the bottom of the second hexagonal segment is substantially coplanar with the top of the first hexagonal segment.

Two inlets of the portable flaring apparatus are secured to the outlets of an external separator. Gas enters the apparatus from an external separator through the two inlets. Gas flows into the volume pot, where any residual liquid present in the gas is condensed and removed. Gas exits the pot and flows through the meter pipe, causing the associated meter to display a value associated with at least the gas and/or the gas flow. The gas then flows through the master control valve and through the blast arrester toward the manifold. At the manifold, the gas flows through any of the plurality of connections that are attached and have open valves. The gas then flows to the combustion tips disposed in a burner box within the stack, which are ignited by electric currents or voltages in order to burn the gas.

The blast arrester substantially ensures that the combustion occurring in the stack does not cause excessive heat, energy, or heated and/or combusting gas to flow backwards through the system toward the volume pot, preventing a dangerous condition. The blast arrester must be of suitable strength to vent or otherwise absorb the energy from the combustion without incurring significant damage.

The master control valve is operable to stop the flow of gas from the volume pot through the blast arrester to the manifold. However, it will be understood that the master control valve can be installed at various points in the flow, including between the inlet(s) and the volume pot, between the volume pot and the blast arrester, or between the blast arrester and the manifold.

The stack may comprise one or more vents.

An aspect of the present disclosure is that the stack is permanently in a vertical position with respect to the movable platform and/or second platform. That is, the stack need not be moved from a horizontal to a vertical position for operation.

Figure 5:
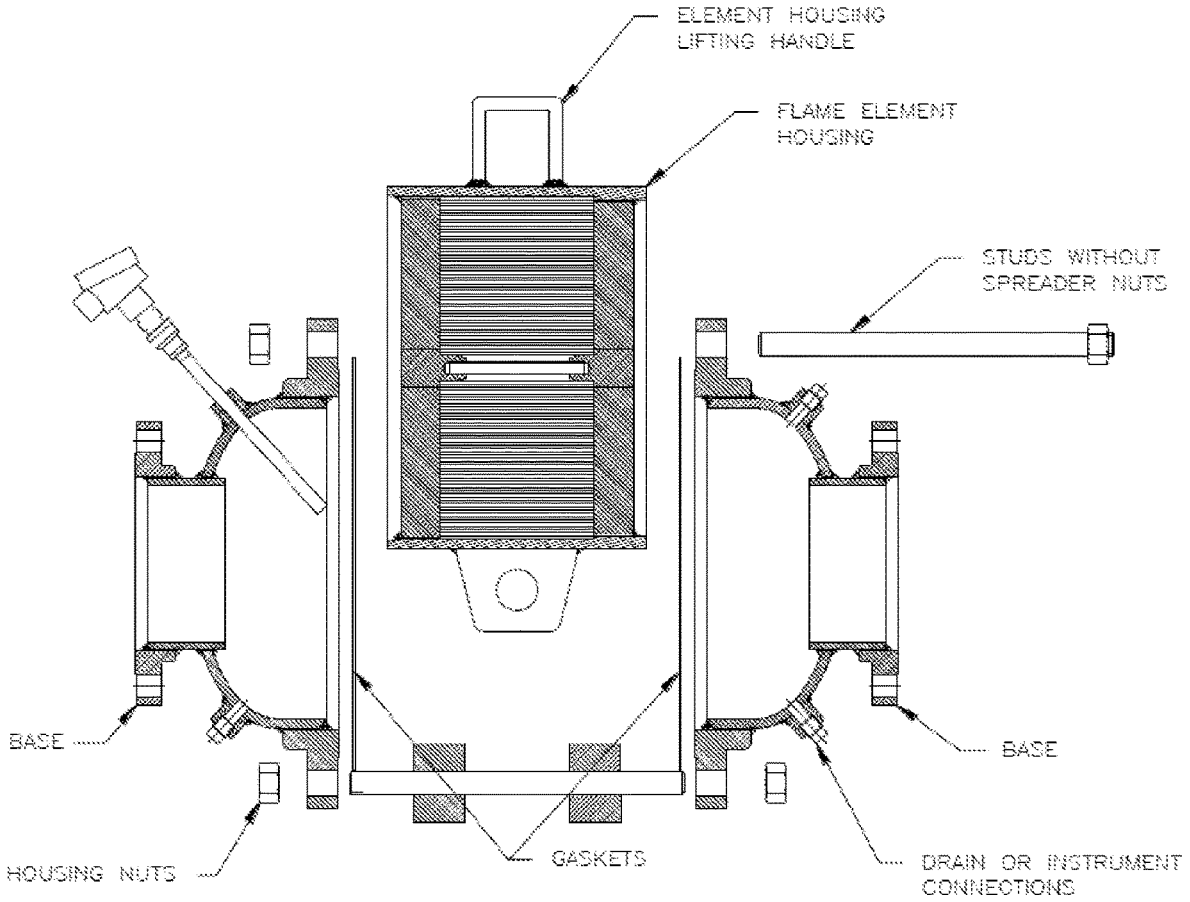
FIG. 5 depicts a blast arrester for use with one embodiment of the present disclosure.

In one embodiment of the present disclosure, the blast arrester is a Groth Model 7658A unstable detonation flame arrester as shown in FIG. 5. The document titled "Installation, Operation and Maintenance Manual for Stable Detonation Flame Arrester" for Model 7658A, available at https://www.arothcorp com/wp-content/uploads/2019/10/IOM-for-Model1-7658AS-Stable-Detonation.pdf, from which FIG. 5 has been reproduced, is incorporated by reference.

Figure 6:
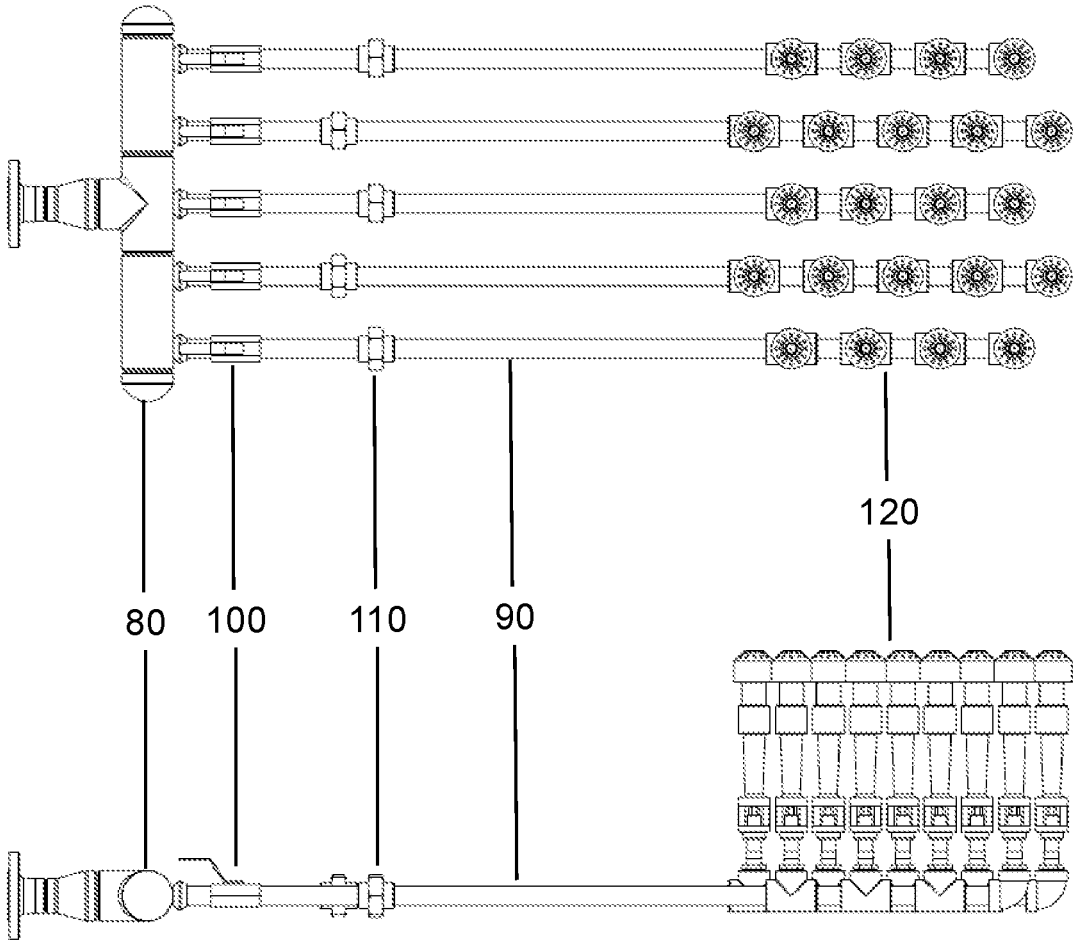
FIG. 6 depicts a combustion tip assembly in accordance with one embodiment of the present disclosure.
Figure 7:
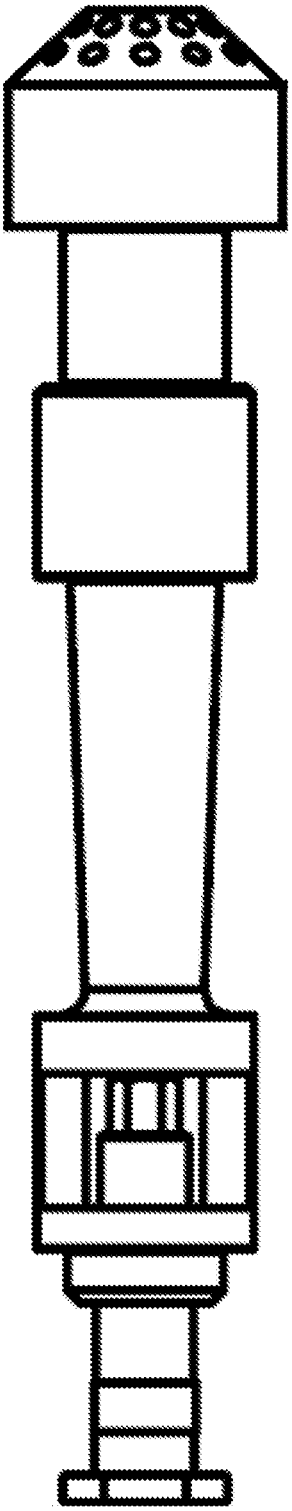
FIG. 7 depicts a combustion tip in accordance with one embodiment of the present disclosure.

In one embodiment of the present disclosure, the combustion tips have a 1- to 5-inch nipple and a 3-inch rosebud head, with a 9/64-inch orifice and a ¾-inch pilot assembly. A detailed illustration of the combustion tip assembly shown in FIG. 1 using combustion tips according to these dimensions is illustrated in FIG. 6. An example combustion tip according to these dimensions is illustrated in FIG. 7.

The present disclosure includes any one or more of the example embodiments as substantially disclosed herein optionally in combination with any one or more other aspects/embodiments as substantially disclosed herein.

The present disclosure includes one or more means adapted to perform any one or more of the above example embodiments as substantially disclosed herein.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. An apparatus comprising:
at least one inlet configured for intake of gas;
a stack having a perimeter;
an arrester disposed radially outside the perimeter of said stack;
a manifold coupled to said arrester comprising a plurality of connections, each connection associated with at least one valve and with at least one joiner, and each connection connected to at least one combustion tip, said manifold disposed radially outside the perimeter of said stack; and
a plurality of combustion tips comprising the combustion tips connected to said plurality of connectors disposed within the perimeter of said stack;
wherein each valve is configured to allow a connection associated with said valve to be independently opened and closed to control a flaring rate; and
wherein said stack comprises:
a first segment comprising:
a first hollow polygonal shaft; and
a first hollow cylindrical shaft surrounded entirely by said first hollow polygonal shaft;
wherein said first hollow polygonal shaft has a first upper polygonal edge, and said first hollow cylindrical shaft has a first circular upper edge that is horizontally aligned with said first upper polygonal edge; and
a second segment comprising:
a second hollow polygonal shaft of smaller width than said first hollow polygonal shaft; and
a second hollow cylindrical shaft of smaller diameter than said first hollow cylindrical shaft surrounded entirely by said second hollow polygonal shaft;
wherein said second hollow polygonal shaft has a second upper polygonal edge, and said second hollow cylindrical shaft has a second circular upper edge that is horizontally aligned with said second upper polygonal edge.

2. The apparatus of claim 1, wherein said arrester is a detonation flame arrester.

3. The apparatus of claim 1, wherein said first segment and said second segment are of substantially equal height.

4. The apparatus of claim 1, wherein said first hollow polygonal shaft and said second hollow polygonal shaft are octagonal in shape.

5. The apparatus of claim 1, wherein said first polygonal exterior shaft and said second polygonal exterior shaft are hexagonal in shape.

6. The apparatus of claim 1, wherein at least one of said first hollow polygonal shaft and said second hollow polygonal shaft is at least partially formed of expanded metal grating.

7. The apparatus of claim 1, wherein both of said first hollow polygonal shaft and said second hollow polygonal shaft are at least partially formed of expanded metal grating.

8. The apparatus of claim 1, wherein said plurality of connections consists of at least five connections.

9. The apparatus of claim 1, wherein each connection is connected to at least four combustion tips.

10. An apparatus comprising:
a trailer, said trailer comprising:
a platform;
at least one inlet configured for intake of gas;
a stack having a perimeter;
an arrester disposed radially outside the perimeter of said stack;
a manifold coupled to said arrester comprising a plurality of connections, each connection associated with at least one valve and with at least one joiner, and each connection connected to at least one combustion tip, said manifold disposed radially outside the perimeter of said stack; and
a plurality of combustion tips comprising the combustion tips connected to said plurality of connectors tips disposed within the perimeter of said stack;
wherein each valve is configured to allow a connection associated with said valve to be independently opened and closed to control a flaring rate; and
wherein said stack comprises:
a first segment comprising:
a first hollow polygonal shaft; and
a first hollow cylindrical shaft surrounded entirely by said first hollow polygonal shaft;
wherein said first hollow polygonal shaft has a first upper polygonal edge, and said first hollow cylindrical shaft has a first circular upper edge that is horizontally aligned with said first upper polygonal edge; and
a second segment comprising:
a second hollow polygonal shaft of smaller width than said first hollow polygonal shaft; and
a second hollow cylindrical shaft of smaller diameter than said first hollow cylindrical shaft, surrounded entirely by said second hollow polygonal shaft;
wherein said second hollow polygonal shaft has a second upper polygonal edge, and said second hollow cylindrical shaft has a second circular upper edge that is horizontally aligned with said second upper polygonal edge;
wherein said at least one inlet, said arrester, and said stack are affixed to said platform.

11. The apparatus of claim 10, wherein said second segment is configured to be disposed within said first segment in a first configuration of said stack, and said second segment is configured to be substantially below said first segment in a second configuration of said stack.

12. The apparatus of claim 11, said stack further comprising:
a third segment of smaller diameter than said second segment, wherein said third segment is configured to be disposed within said second segment in a third configuration of said stack, and said third segment is configured to be substantially below said second segment in a fourth configuration of said stack; and a fourth segment of smaller diameter than said third segment, wherein said fourth segment is configured to be disposed within said third segment in a fifth configuration of said stack, and said fourth segment is configured to be substantially below said third segment in a sixth configuration of said stack.

13. The apparatus of claim 10, wherein said second segment is of a first height, and said first segment is of a second height approximately twice said first height.

14. The apparatus of claim 13, wherein said first segment comprises two subsegments, wherein each subsegment is approximately of said first height.

15. The apparatus of claim 10, wherein said plurality of connections consists of at least five connections.

16. The apparatus of claim 10, wherein each connection is connected to at least four combustion tips.

* * * * *